US008918028B2

(12) United States Patent
Takahashi et al.

(10) Patent No.: US 8,918,028 B2
(45) Date of Patent: Dec. 23, 2014

(54) TONER CONVEYING PATH FORMING MEMBER, TONER REPLENISHMENT UNIT, AND IMAGE FORMING APPARATUS

(71) Applicant: Ricoh Company, Limited, Ohta-Ku, Tokyo (JP)

(72) Inventors: Masaki Takahashi, Kanagawa (JP); Toshiki Hayashi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 12 days.

(21) Appl. No.: 13/740,377

(22) Filed: Jan. 14, 2013

(65) Prior Publication Data

US 2013/0195509 A1 Aug. 1, 2013

(30) Foreign Application Priority Data

Jan. 31, 2012 (JP) ..... 2012-018173

(51) Int. Cl.
*G03G 15/08* (2006.01)

(52) U.S. Cl.
CPC ..... *G03G 15/0865* (2013.01); *G03G 15/0879* (2013.01)
USPC ..... 399/258; 399/120; 399/260; 399/358

(58) Field of Classification Search
USPC ..... 399/120, 224, 258, 260, 358
See application file for complete search history.

(56) References Cited

U.S. PATENT DOCUMENTS

| | | | | |
|---|---|---|---|---|
| 5,708,952 | A * | 1/1998 | Taniguchi et al. | 399/358 |
| 5,778,296 | A * | 7/1998 | van der Steen et al. | 399/360 |
| 6,014,541 | A * | 1/2000 | Kato et al. | 399/358 |
| 7,068,968 | B2 * | 6/2006 | Choi et al. | 399/360 |
| 8,103,195 | B2 | 1/2012 | Yoshida et al. | |
| 2007/0253745 | A1 * | 11/2007 | Maruyama | 399/258 |
| 2008/0118290 | A1 | 5/2008 | Sato | |
| 2010/0232852 | A1 * | 9/2010 | Noso | 399/358 |
| 2010/0272475 | A1 * | 10/2010 | Yamamoto | 399/258 |
| 2011/0058858 | A1 | 3/2011 | Fukuda et al. | |
| 2011/0194874 | A1 | 8/2011 | Masuda et al. | |
| 2011/0305485 | A1 | 12/2011 | Oshikawa et al. | |
| 2012/0057907 | A1 | 3/2012 | Taguchi et al. | |
| 2012/0200871 | A1 | 8/2012 | Takahashi et al. | |
| 2012/0207492 | A1 | 8/2012 | Fujiwara et al. | |

FOREIGN PATENT DOCUMENTS

| | | |
|---|---|---|
| CN | 101464646 A | 6/2009 |
| JP | 2007-241007 | 9/2007 |
| JP | 4462492 | 2/2010 |

OTHER PUBLICATIONS

U.S. Appl. No. 13/556,433, filed Jul. 24, 2012, Hideki Kimura, et al.
Chinese Office Action dated Aug. 19, 2014 for CN 201310088105.2.

* cited by examiner

*Primary Examiner* — Francis Gray
(74) *Attorney, Agent, or Firm* — Harness, Dickey & Pierce PLC

(57) ABSTRACT

A toner conveying path forming member forms a toner conveying path with a hollow capable of conveying toner. The toner conveying path forming member includes an inner wall a part of which is pressed by an elastic toner conveying member provided in the toner conveying path; and a protrusion that is provided on an inner wall surface of at least a part of the inner wall to protrude toward the hollow.

11 Claims, 7 Drawing Sheets

TONER CONVEYING PATH FORMING MEMBER, TONER REPLENISHMENT UNIT, AND IMAGE FORMING APPARATUS

CROSS-REFERENCE TO RELATED APPLICATIONS

The present application claims priority to and incorporates by reference the entire contents of Japanese Patent Application No. 2012-018173 filed in Japan on Jan. 31, 2012.

BACKGROUND OF THE INVENTION

1. Field of the Invention

The present invention relates to a toner conveying path forming member used for an image forming apparatus such as a copying machine, a printer, a facsimile machine, and an MFP, a toner replenishment unit including the toner conveying path forming member, and an image forming apparatus including the toner replenishment unit.

2. Description of the Related Art

In the related art, an image forming apparatus including a toner replenishment unit that supplies toner to a developing unit has been known. The developing unit visualizes, by using the toner, latent images formed on the surface of photosensitive drums or the like serving as latent image carriers into toner images. Some of such toner replenishment units have a toner conveying device and a toner housing container or the like.

As for the toner conveying device, such a toner conveying device has been known including, for example, a receiving unit that receives toner from the toner housing container, a delivery unit that delivers the toner to the developing unit, and a hollow circular pipeline unit that guides the toner from the receiving unit to the delivery unit. The receiving unit, the delivery unit, and the pipeline unit respectively function as the toner conveying path forming member forming a toner conveying path.

As for the toner housing container, a toner bottle composed of a tubular cylindrical member having a hollow has been known, for example. In the toner bottle, the toner is discharged from an outlet of the toner bottle provided on the side face of an end of the toner bottle. The toner housing container itself may function as the toner conveying path forming member forming the toner conveying path.

In response to a demand for downsizing the image forming apparatus, there are more image forming apparatuses in which a toner conveying member having elasticity is arranged as the toner conveying unit in the pipeline unit of the toner conveying device or inside the toner housing container that functions as the toner conveying path forming member.

By providing an elastic toner conveying member, for example, inside the pipeline unit, the stable toner conveyance ability can be ensured even if a curved portion, where the center line of the pipeline unit that passes through the center of the hollow section perpendicular to the toner conveying direction is curved, is provided. As described above, by providing the curved portion inside the pipeline unit while ensuring the toner conveyance ability, the layout flexibility of the toner replenishment unit in the apparatus is increased compared to the structure in which only the effect of gravity is utilized, and a layout capable of downsizing the main body of the image forming apparatus is also available.

By arranging the toner conveying member having elasticity inside the toner housing container, the stable toner conveyance ability and toner agitating ability can be ensured even with the structure in which the center line passing through the center of the hollow section perpendicular to the toner conveying direction of the toner housing container is arranged substantially horizontal and the height of the main body of the image forming apparatus is shortened. As described above, by arranging the center line of the toner housing container substantially horizontal, while ensuring the toner conveyance ability and toner agitating ability, the main body of the image forming apparatus can also be downsized compared to the structure in which only the effect of gravity is utilized.

However, with the structure in which the elastic toner conveying member is arranged in the toner conveying path forming member, a part of the inner wall of the toner conveying path forming member may be pressed by the toner conveying member directly or via the toner. If the inner wall is pressed as described above, a part of the toner that is being conveyed may be sandwiched at a sandwich field formed between the toner conveying member and the inner wall surface of the toner conveying path forming member and undergoes pressure, thereby generating aggregated toner particles.

If the aggregated toner particles generated in the sandwich field is supplied to the developing unit, without being broken down in the toner conveying path, the defective images are generated as follows, for example. The aggregated toner particles are caught by a member for limiting a developer layer thickness of the developing unit, to cause the developer layer on a developing roller serving as a developer carrier to become uneven, thereby generating defective images such as a white vertical line on the image.

In the related art, the following method has been known as a method for suppressing the generation of the aggregated toner particles in the toner conveying path forming member. In the method, a degree of aggregation serving as one of characteristic values of toner to be used is regulated by two types of mesh opening of a sieve (sieve oscillation measurement method) (Japanese Patent No. 4462492). However, the characteristic values of toner are likely to be influenced by use environment such as temperature and humidity for the image forming apparatus. Accordingly, the characteristic values of the toner cannot be controlled depending on the use environment, whereby sometimes the generation of the aggregated toner particles in the toner conveying path forming member cannot be suppressed.

Therefore, there is a need for a toner conveying path forming member that is hardly influenced by use environment and is capable of suppressing the generation of aggregated toner particles that can cause defective images, even when a part of the inner wall of the toner conveying path forming member is pressed by an elastic toner conveying member provided in a toner conveying path.

SUMMARY OF THE INVENTION

According to an embodiment, there is provided a toner conveying path forming member forms a toner conveying path with a hollow capable of conveying toner. The toner conveying path forming member includes an inner wall a part of which is pressed by an elastic toner conveying member provided in the toner conveying path; and a protrusion that is provided on an inner wall surface of at least a part of the inner wall to protrude toward the hollow.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
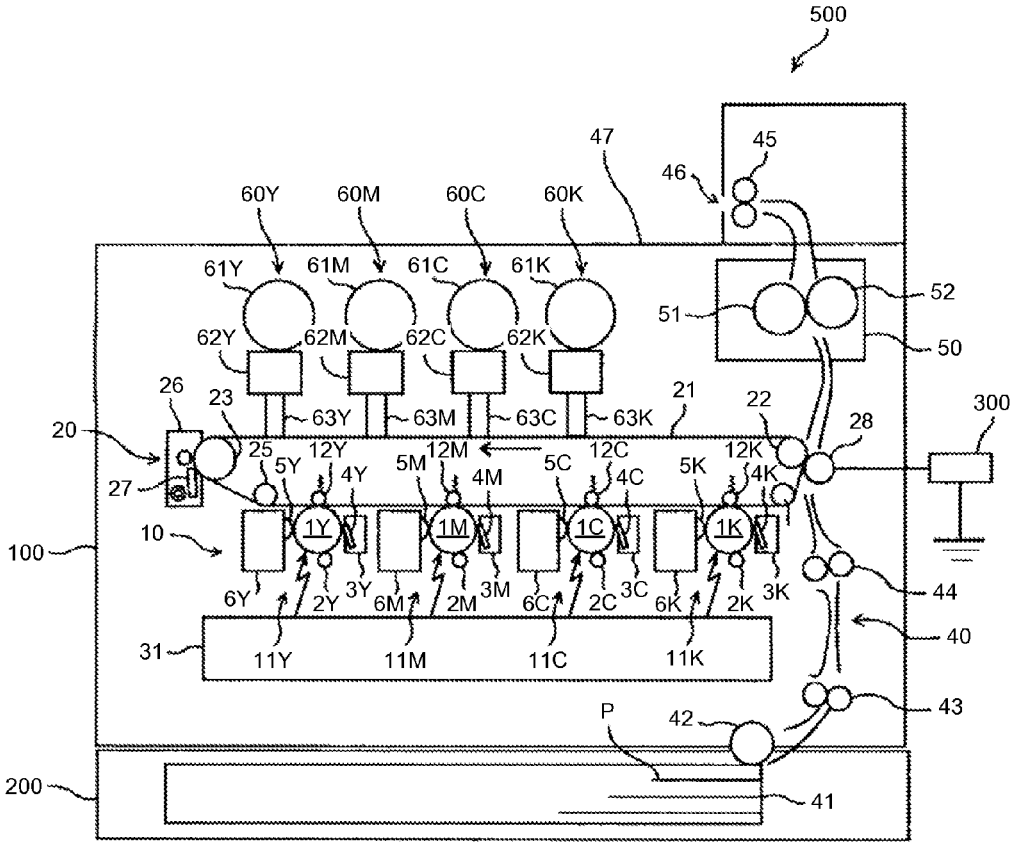
FIG. 1 is a schematic diagram for explaining a printer according to an embodiment of the present invention.

An embodiment in which the present invention is applied to a color printer as an image forming apparatus adopting electrophotography (hereinafter, referred to as a printer 500) will now be described with reference to some examples. First, the structure and operations of the printer 500 common to the examples below will be described with reference to the accompanying drawings. In the embodiments, an example is described below in which the present invention is applied to the printer 500 of a so-called "tandem" type with an intermediate transfer system. However, the present invention is not limited to this example. The present invention can also be applied to, for example, an image forming apparatus in which a single color image is formed, or an image forming apparatus including an electrophotography with a direct transfer system. The present invention is not limited to a printer, but can be applied to an electrophotography image forming apparatus such as a copying machine, a facsimile machine, and an MFP. FIG. 1 is a schematic diagram for explaining the printer 500 according to the embodiment of the present invention.

First, the basic structure of the printer 500 according to the present embodiment will be described. As illustrated in FIG. 1, in the nearly center position in the vertical direction of a main body 100 of the printer 500, an intermediate transfer unit 20 including an endless intermediate transfer belt 21 serving as an intermediate transfer body is arranged. Below the intermediate transfer unit 20, an image forming unit 10 including four process cartridges 11Y, 11M, 11C, and 11K for generating toner images of yellow, magenta, cyan, and black (hereinafter, marked as Y, M, C, and K) is arranged. Below the image forming unit 10, an optical writing device 31 is arranged that radiates laser lights forming respective electrostatic latent images on the surfaces of photosensitive drums 1Y, 1M, 1C, and 1K serving as latent image carriers included in each of a process cartridges 11. Above the intermediate transfer unit 20, toner bottles 61 are arranged serving as the toner housing containers of a toner replenishment units 60Y, 60M, 60C, and 60K that supply toner to respective developing units 6Y, 6M, 6C, and 6K included in each of the process cartridges 11.

On the right side of the intermediate transfer unit 20 and the image forming unit 10 in the main body 100 illustrated in FIG. 1, a sheet conveying path 40 that conveys a sheet P that has been fed from a paper feeding unit 200 is provided. On the downstream side of a secondary transfer unit of the intermediate transfer unit 20 in the sheet conveying direction of the sheet P (i.e., the upper side of the secondary transfer unit), a fixing unit 50 including a fixing roller 51 and a pressing roller 52 with a heating unit (not illustrated) that fixes toner images on the sheet P after secondary transfer is arranged. Further on the downstream side of the fixing unit 50 in the sheet conveying direction of the sheet P, a pair of ejecting rollers 45 is provided so that the sheet P on which the toner images have been fixed is ejected from an ejecting port 46 and loaded onto a loading tray 47 formed on the upper part of the main body 100.

Below the main body 100, the paper feeding unit 200 including a paper cassette 41 that stores the sheet P such as a transfer sheet serving as a recording medium is provided. There is also provided a control unit (not illustrated) that controls the devices in the apparatus based on signals from external devices such as a personal computer or a process control program such as a program for density adjustment.

Except that for each of the process cartridges 11 provided in the image forming unit 10 uses different color toner from each other, i.e., Y, M, C, and K as an image forming material, the structures are the same, thus in the descriptions below, the signs Y, M, C, and K are omitted as necessary. Each of the process cartridges 11 is replaced when it reaches its lifetime. Each of the process cartridges 11 includes a photosensitive drum 1 that holds and carries electrostatic latent images, a roller charging device 2 that uniformly charges the surface on the photosensitive drum 1, and a developing unit 6 having a developing roller 5 that develops the electrostatic latent images using the toner and having two agitating and conveying screws (not illustrated). The process cartridge 11 also includes a photosensitive-element cleaning unit 3 having a photosensitive-element cleaning blade 4 that removes remaining toner on the photosensitive drum 1 after primary transfer, and a neutralization device (not illustrated). The photosensitive drums 1Y, 1M, 1C, and 1K are arranged in this order from the upstream side to the downstream side in the moving direction of the intermediate transfer belt 21 along the process cartridges 11Y, 11M, 11C, and 11K so that each of the photosensitive drums 1 comes into contact upward with the surface of the intermediate transfer belt 21.

Each of the toner replenishment units 60 that supplies the developing unit 6 with toner mainly includes the toner housing container and the toner conveying device, both of which constitute a part of the toner conveying path of the toner replenishment unit. In the present embodiment, as the toner housing container, a bottle main body 81 of the toner bottle 61 composed of a tubular cylindrical member with a hollow section that discharges the toner from an outlet of the toner bottle provided on the side face of an end of the toner bottle (refer to FIGS. 6A to 6C and 7A to 7C) is provided in the image forming apparatus. A toner conveying unit having an elastic toner conveying member, which will be described later, that rotates to transfer the toner toward the outlet of the toner bottle is provided inside a hollow of the bottle main body 81 of the toner bottle 61. The rotation of the toner conveying member also provides an effect of agitating the toner contained in the toner housing container.

The toner conveying device includes a receiving unit that receives the toner from the toner bottle 61, a delivery unit that delivers the toner to the developing unit, and a pipeline unit having a circular hollow section that guides the toner from the receiving unit to the delivery unit. The receiving unit, the delivery unit, and the pipeline unit respectively serve as the toner conveying path forming member that forms the toner conveying path. In the present invention, as the receiving unit, there is provided a hopper 62 with two vessels that temporarily stores the toner discharged from the toner bottle 61 and has a paddle (not illustrated) that agitates and conveys the toner, and a conveying screw (not illustrated) that conveys the toner. As the pipeline unit, a pipeline unit 63 having the hollow section is provided. At an end of the opposite side of the hopper 62, a delivery unit (not illustrated) having an opening that transfers the toner to a toner supply port (not illustrated) of the developing unit 6 is provided. Also a toner conveying unit is provided that includes an elastic toner conveying member, which will be described later, that rotates to transfer the toner toward the opening of the delivery unit inside a hollow of the toner bottle 61.

The intermediate transfer unit 20 includes the intermediate transfer belt 21 and supporting rollers 22, 23, 24, and 25 supporting the intermediate transfer belt 21 that is bridged thereacross. The intermediate transfer unit 20 also includes a secondary transfer roller 28 that serves as the secondary transfer unit by sandwiching the sheet P with the intermediate transfer belt 21 bridged over the supporting roller 22. To the secondary transfer roller 28, a bias applying device 300 that applies a secondary transfer bias voltage is coupled. There is also provided a belt cleaning device 26 having a belt cleaning blade 27 that comes in contact with the surface (outer circumference surface) of the intermediate transfer belt 21 bridged over the supporting roller 23 to remove remaining toner on the intermediate transfer belt 21 after secondary transfer. On the inner circumference surface of the intermediate transfer belt 21 on the positions facing each of the photosensitive drums 1, primary transfer rollers 12 to each of which a primary transfer bias voltage for primary-transferring the toner images on the photosensitive drum 1 onto the intermediate transfer belt 21 is applied, are arranged to press the intermediate transfer belt 21 toward the photosensitive drums 1.

Image forming operations of the printer 500 will now be described. After receiving image signals from an external device such as a personal computer, the printer 500 starts driving to rotate the photosensitive drum 1 included in each of the process cartridges 11 and the intermediate transfer belt 21 under the control of the control unit. Simultaneously with the rotational driving, the surface on each of the photosensitive drums 1 is uniformly charged by the roller charging device 2 included in each of the process cartridges 11, and then irradiated with a laser light from the optical writing device 31 based on the image signals, whereby electrostatic latent images are formed on each of the photosensitive drums 1. The electrostatic latent images formed on each of the photosensitive drums 1 are developed after the toner of respective colors is transferred at the positions facing each of the developing rollers 5 included in each of the developing units 6 through the rotation of the photosensitive drums and the toner images are held on the photosensitive drum 1.

The respective color toner images that are held on each of the photosensitive drums 1 are conveyed via the intermediate transfer belt 21 to primary transfer positions to which each of the primary transfer rollers 12 is facing. The respective color toner images are primary-transferred onto the intermediate transfer belt 21 through the primary transfer bias voltage applied to each of the primary transfer rollers 12, in a superimposing manner sequentially, whereby color toner images are formed on the intermediate transfer belt 21. The color toner image formed on the intermediate transfer belt 21 is moved to a secondary transfer position faced by the secondary transfer roller 28, through the movement of the intermediate transfer belt 21. The remaining toner after transfer on each of the photosensitive drums 1 is removed by the photosensitive-element cleaning blade 4 included in each of the photosensitive-element cleaning units 3. Each of the photosensitive drums 1 from which the remaining toner after transfer is removed is then neutralized by the neutralization device to be ready for a subsequent image forming process.

Through the rotation of a paper feeding roller 42, a sheet of the sheet P is picked up from the paper cassette 41 of the paper feeding unit 200, fed into the sheet conveying path 40, conveyed through the rotation of a pair of sheet conveying rollers 43, and comes in contact with a pair of registration rollers 44 to be stopped. Then, the pair of registration rollers 44 is driven to rotate at a moving timing of the color toner images on the intermediate transfer belt 21, whereby the sheet P is conveyed to the secondary transfer position. At the secondary transfer position, the color toner images held on the intermediate transfer belt 21 is secondary-transferred onto the sheet P sandwiched between the intermediate transfer belt 21 and the secondary transfer roller 28 through the secondary transfer bias voltage applied to the secondary transfer roller 28. The remaining toner after transfer is removed by the belt cleaning blade 27 included in the belt cleaning device 26 to be ready for a subsequent image forming process.

The sheet P on which the color toner images are transferred is pressured and heated by the fixing roller 51 and the pressing roller 52 in the fixing unit 50 provided on the downstream side of the secondary transfer unit in the sheet conveying direction, whereby the color toner images are fixed onto the sheet P. The sheet P on which the color toner images are fixed is ejected and loaded on the loading tray 47 by rotation of the pair of ejecting rollers 45 provided on an ejecting unit. This is the end of a series of image forming operations.

In the present embodiment, the structure including the two-component developing unit 6 using toner and carrier as a developer is described. However, the embodiment is not limited thereto, but can also be applied to the structure including a one-component developing unit.

The toner conveying path forming member provided on the toner replenishment unit 60 of the printer 500 will now be described with reference to some examples.

Example 1

Figure 2:
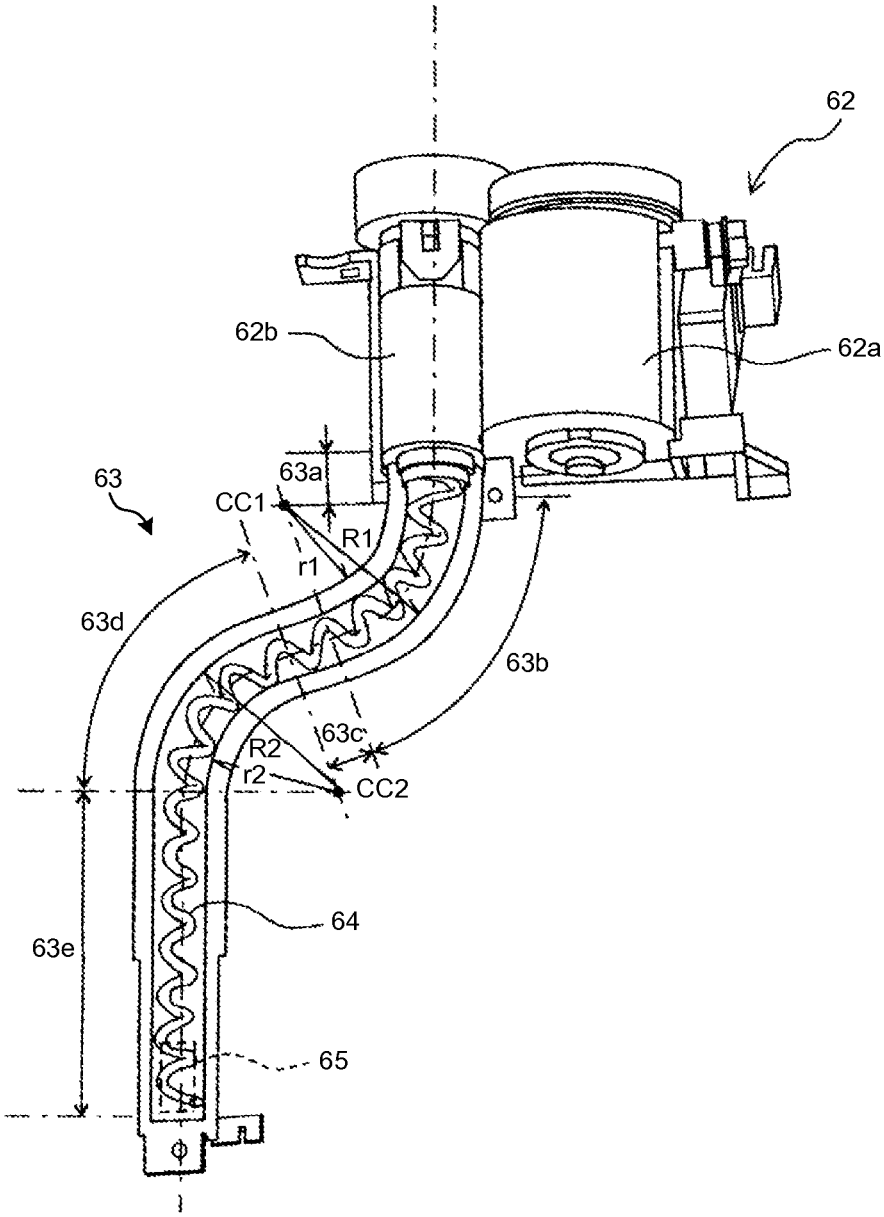
FIG. 2 is a perspective view for explaining a pipeline unit provided on a toner replenishment unit according to Example 1 of the present embodiment.
Figure 3:
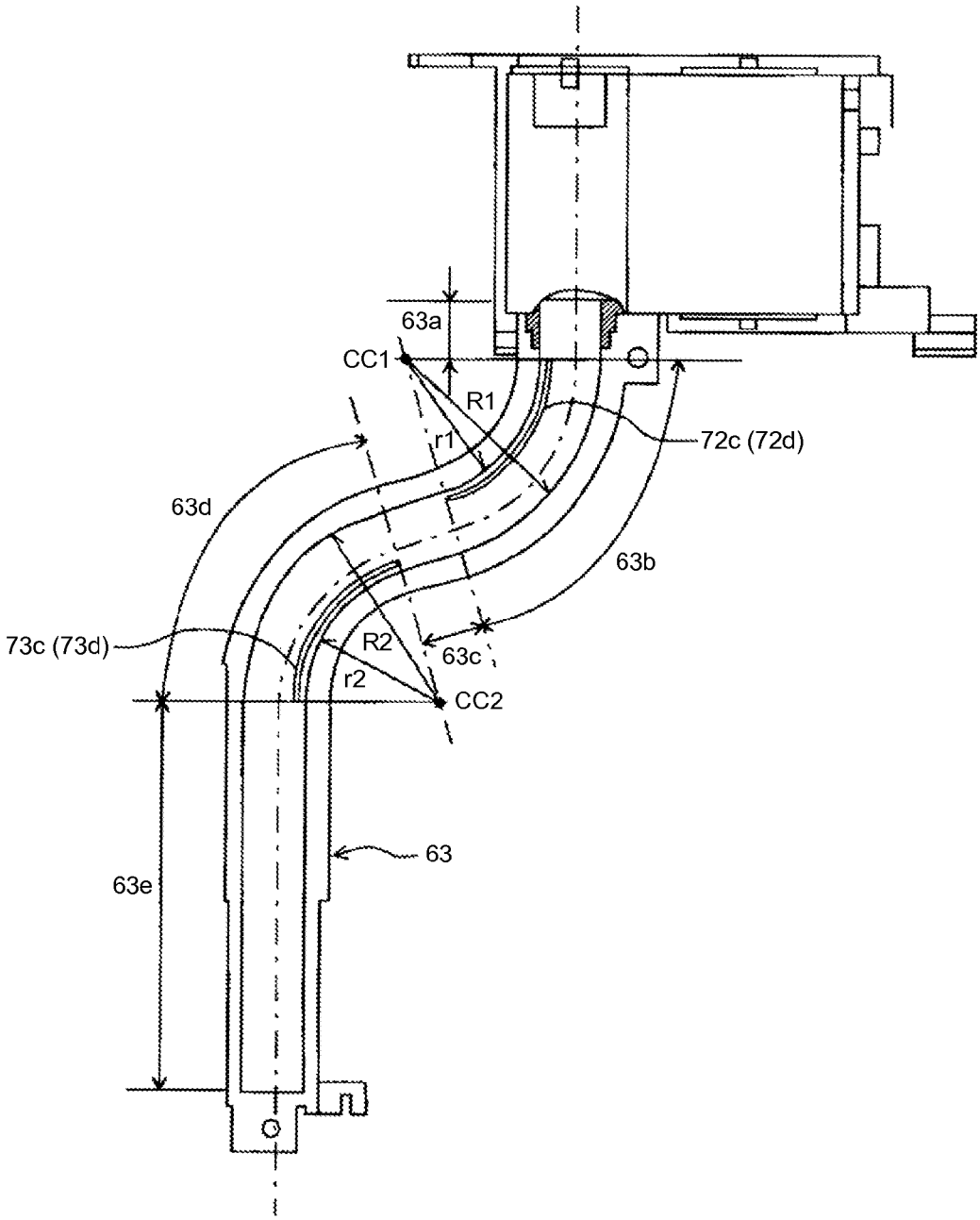
FIG. 3 is an arrangement diagram for explaining protrusions included in the pipeline unit according to Example 1.

As a first example of the present embodiment, Example 1 will be described with reference to the accompanying drawings. In the present example, the present invention is applied to the pipeline unit 63 of the toner conveying device serving as one of the toner conveying path forming members of the toner replenishment unit 60. FIG. 2 is a perspective view for explaining the pipeline unit 63 provided on the toner replenishment unit 60 according to Example 1. FIG. 3 is an arrangement diagram for explaining protrusions included in the pipeline unit 63 according to Example 1. FIGS. 4A to 4G are sectional views for explaining the protrusions included in the pipeline unit 63 according to Example 1. FIGS. 2 and 3 are diagrams of the toner conveying device viewed from below with the lower members of the pipeline part 63 removed.

As illustrated in FIG. 2, the toner conveying device of the present example includes the hopper 62 with two vessels that receives the toner discharged from the toner bottle 61 as the receiving unit, and the pipeline unit 63 coupled to the hopper 62 at one end thereof and having an opening 65 of the delivery unit at the other end thereof. The hopper 62 includes a receiving vessel 62*a* that temporarily stores the toner discharged from the toner bottle 61 and has a paddle (not illustrated) that agitates and conveys the toner toward a conveying vessel 62*b* (not illustrated). The toner conveying device also includes the conveying vessel 62*b* equipped with a conveying screw (not illustrated) that conveys the toner delivered from the receiving vessel 62*a*, in parallel with the receiving vessel 62*a*. In the conveying screw provided in the conveying vessel 62*b*, a groove is formed with which a conveying coil 64 serving as the elastic toner conveying member provided inside the pipeline unit 63 serving as the toner conveying path forming member, which will be described in detail later, is engaged. Therefore, rotation of the conveying screw rotates the conveying coil 64. A driving motor (not illustrated) is driven to rotate under the control of the control unit (not illustrated) according to toner consumption of the developing unit 6, so that the toner is agitated and conveyed in the hopper 62.

The pipeline unit 63 serving as the toner conveying path forming member of the present example has a circular hollow section. The pipeline unit 63 includes two curved portions and three linear portions, specifically, a first linear portion 63*a*, a first curved portion 63*b*, a second linear portion 63*c*, a second curved portion 63*d*, and a third linear portion 63*e* are provided in this order from the upstream side in the toner conveying direction. The first linear portion 63*a* is coupled to the conveying vessel 62*b* of the hopper 62 on the upstream side in the toner conveying direction.

The first curved portion 63*b* is structured so that the center line of the pipe line unit 63 that passes through the center of the hollow section perpendicular to the toner conveying direction (hereinafter, referred as the center line of the conveying path) is bent to the left with CC1 illustrated on the left side in FIG. 2 as the center of curvature. The second curved portion 63*d* is structured so that the center line of the conveying path is bent to the right, i.e., opposite side from the first curved portion, with CC2 illustrated on the right side in FIG. 2 as the center of curvature. The first linear portion 63*a* and the third linear portion 63*e* are arranged so that their respective center lines of the conveying path are substantially in parallel. At the downstream end of the third linear portion 63*e* in the toner conveying direction, the opening 65 of the delivery unit is provided as illustrated in a dashed line in FIG. 2. In this manner, by forming the pipeline unit 63 to have the curved portions, the layout flexibility of the toner replenishment unit 60 in the main body 100 is increased compared to the structure in which only the effect of gravity is utilized without having such curved portions, and a layout capable of downsizing the main body 100 is also available.

In the present example, inside the hollow of the pipeline unit 63 serving as the toner conveying path forming member, the conveying coil 64 serving as the elastic toner conveying member is provided with its one end engaged with the conveying screw provided in the conveying vessel 62*b* of the hopper 62. The conveying coil 64 is driven to rotate in association with the rotation of the conveying screw of the hopper 62 and conveys the toner in the pipeline unit 63. In this manner, by arranging the conveying coil 64 in the pipeline unit 63, the toner can be conveyed stably even with the structure in which curved portions are provided in the pipeline unit 63. In addition, the toner can be conveyed in any direction because the conveying coil 64 has elasticity. The conveying coil 64 is arranged in the toner conveying path formed with the pipeline unit 63 in a deformed state by contacting a part of the inner wall of the pipeline unit 63 serving as the toner conveying path forming member having elasticity. The conveying coil 64 and the inner wall of the pipeline unit 63 are arranged so that a gap is generated therebetween when the center line of the conveying coil 64 and the center line of the pipeline unit 63 are overlapped. Accordingly, the conveying coil 64 having elasticity partially comes in contact with the inner wall of the pipeline unit 63, thus deforms so as to be more linearly than the center line of the conveying path of the pipeline unit 63 having the curved portion.

At the part of the inner wall with which the conveying coil 64 comes in contact, reaction force is generated as contact pressure in response to the force that has bent the conveying coil 64 having elasticity. Accordingly, although undergoing the effect of gravity, the conveying coil 64 is pressed so as to come in contact with the part of the inner wall depending on the shape of mainly the curved portions and the parts coupled to the both ends of the curved portions, i.e., the shape of the pipeline unit 63 in a longitudinal direction.

When the conveying coil 64 is pressed as described above, a contact field where the conveying coil directly comes in contact with the inner wall of the pipeline unit 63 to generate the contact pressure and a close field where the conveying coil 64 presses the inner wall of the pipeline unit 63 via the toner are generated. In other words, a sandwich field of the toner including the contact field and the close field is formed between the conveying coil 64 and the inner wall surface of the pipeline unit 63. The conveying coil 64 conveys the toner while rotating, thus the part of the toner that is being conveyed is sandwiched at the sandwich field formed between the conveying coil 64 and the inner wall surface of the pipeline unit 63. As a result, pressure is applied to the toner and aggregated toner particles may be generated in the sandwich field. If the aggregated toner particles generated in the sandwich field is supplied to the developing unit 6, without being broken down in the pipeline unit 63, a defective image is generated as follows. The aggregated toner particles are caught by the part of a member for limiting the developer layer thickness (not illustrated) of the developing unit 6, whereby the developer layer on the developing roller 5 serving as the developer carrier becomes uneven, thereby generating defective images such as white vertical lines.

To suppress the aggregated toner particles to be generated in the pipeline unit 63 serving as the toner conveying path forming member, which causes the defective images as described above, the following methods can be used in addition to the method for controlling certain characteristic values of toner as disclosed in Japanese Patent No. 4462492. One method is to reduce the pressure applied to the toner in the pipeline unit 63 to such a degree that no aggregated toner particles are generated. Another method is to reduce the size of the aggregated toner particles generated in the pipeline unit 63. The structure in which the curved portion is provided in the pipeline unit 63 is effective for downsizing the main body. However, with the method to reduce the pressure applied to the toner, both suppression of the defective images due to the aggregated toner particles and downsizing of the main body 100 can hardly be achieved at the same time.

The present inventors have studied hard to reduce the size of the aggregated toner particles. As a result of the hard study, they have found that the size of the aggregated toner particles is proportional to the area in which the sandwich field is projected onto a cross section perpendicular to the center line of the conveying path of the toner conveying path forming member (hereinafter, referred to as an area of the sandwich field). In the present example, the size of the aggregated toner particles generated in the pipeline unit 63 that forms the toner conveying path of the hollow is proportional to the area of the sandwich field formed between the conveying coil 64 and the inner wall surface of the pipeline unit 63.

Therefore, in the present example, on the inner wall surface of the pipeline unit 63 that is pressed by the conveying coil 64 in a contacting manner as illustrated in FIG. 2, protrusions such as 72*c* and 72*d*, and 73*c* and 73*d* that protrude toward the hollow are provided as illustrated in FIG. 3, to reduce the area of the sandwich field.

The conveying coil 64 is a wire having a substantially circular cross section and bent in a spiral manner, thus the sandwich field is formed by being sandwiched between a substantially circular periphery of the wire of the conveying coil 64 bent in a spiral manner and the substantially circular inner wall surface of the pipeline unit 63. Accordingly, the area providing an indication of the size of an aggregated field of the toner may be as follows: the area of the cross section perpendicular to the center line of the wire of the conveying coil 64 in the sandwich field, the area of the periphery of the wire of the conveying coil 64 in the sandwich field, and the area of the inner wall surface of the pipeline unit 63 in the sandwich field. In addition, the area in which the sandwich field is projected onto a cross section of the pipe line unit 63 parallel to the center line of the conveying path, and the area of the sandwich field, i.e., the area in which the sandwich field is projected onto a cross section of the pipe line unit 63 perpendicular to the center line of the conveying path may be conceivable. In the present example, the area of the sandwich field is adopted in which the sandwich field is projected onto a cross section of the pine line unit 63 perpendicular to the center line of the conveying path, out of the areas in which the sandwich field is projected onto a cross section in parallel with or perpendicular to the center line of the conveying path, which are significantly affected when the protrusion is provided.

The size of the area of the sandwich field formed between the conveying coil 64 and the inner wall surface of the pipeline unit 63 can be readily compared using the following manner: on a cross section of the pipe line unit 63 perpendicular to the center line of the conveying path, the length of the sandwich field perpendicular to the line passing through both of the center line of the conveying path and the center of a circular arc forming the sandwich field of the conveying coil 64 in the circumferential direction (hereinafter, referred to as a length of the sandwich field). In the descriptions below, the size of the area of the sandwich field will be compared using the length of the sandwich field.

Figure 4A:
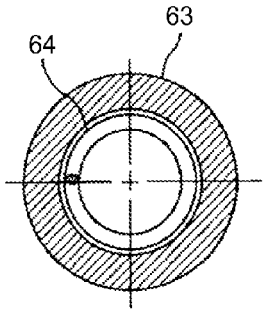
FIGS. 4A to 4G are sectional views for explaining the protrusion included in the pipeline unit according to Example 1.

The sandwich field formed between the conveying coil 64 and the pipeline unit 63 will now be described with reference to FIGS. 4A to 4G. The shapes of the conveying coil 64 illustrated in FIGS. 4B to 4G reflect the shapes in which the conveying coil 64 is projected onto a cross section of the second curved portion 63*d* perpendicular to the center line of the conveying path. Assume that the conveying coil 64 illustrated in FIGS. 4B to 4E has no inclination to bend and the conveying coil 64 is pressed so as to contact a certain position of the inner wall of the second curved portion 63*d*. When the pipeline unit 63 has no curved portion and the conveying coil 64 is not affected by the effect of gravity, then the center line of the conveying path of the pipeline unit 63 and the center line of the conveying coil 64 are coaxial, as illustrated in FIG. 4A. The inner wall of the pipeline unit 63 and the conveying coil 64 have a certain gap therebetween.

Figure 4B:
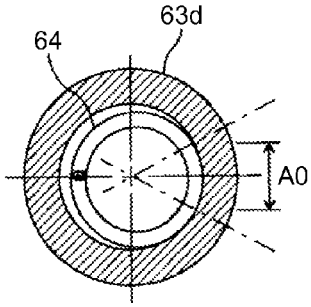
Figure 4C:
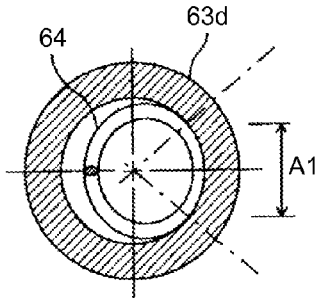

However, according to the pipeline unit 63 of the present example including the first curved portion 63*b* and the second curved portion 63*d*, in the second curved portion 63*d* as illustrated in FIG. 2, for example, the conveying coil 64 is pressed so as to contact the inner wall surface at the side of a smaller radius curvature r2 closer to the center of curvature CC2. As a result, as seen in the cross section perpendicular to the center line of the conveying path of the second curved portion 63*d* illustrated in FIG. 4B, the sandwich field is formed on the inner wall surface at the side of the smaller radius of the pipeline unit 63 in the length of the sandwich field indicated with A0 in FIG. 4B. The aggregated toner particles are generated in proportion to the area of the sandwich field that has been formed in the length of the sandwich field indicated with A0. That is to say, the aggregated toner particles in proportion to the length of the sandwich field indicated with A0 are generated. If the conveying coil 64 is made of a deformable material, as illustrated in FIG. 4C, the conveying coil 64 deforms to an oval shape, thus the sandwich field with the length of the sandwich field indicated with A1 longer than the length of the sandwich field indicated with A0 is formed (A1>A0). As a result, when the conveying coil 64 deforms to an oval shape, more aggregated toner particles are generated compared to the structure illustrated in FIG. 4B.

Figure 4D:
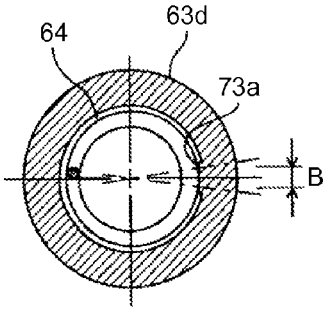

In this respect, as illustrated in FIG. 4D, a protrusion 73*a* having a rectangular cross section protruding toward the hollow is provided along the inner wall surface at the side of the smaller radius curvature r2 closer to the center of curvature of the second curved portion 63*d*. By providing the protrusion 73*a*, the length of the sandwich field indicated with B in FIG. 4D formed between the conveying coil 64 and the inner wall surface of the second curved portion 63*d* (i.e., the rectangular protrusion 73*a*) can be further shortened than the length of the sandwich field in FIGS. 4B and 4C (A1>A0>B). In other words, the area of the sandwich field in which the toner is sandwiched between the conveying coil 64 and the inner wall part of the second curved portion 63*d* can be reduced. By reducing the area of the sandwich field as described above, the size of the aggregated toner particles generated when sandwiched in the sandwich field and while undergoing pressure can be reduced, and thus the generation of the aggregated toner particles that can cause the defective images can be suppressed.

As described above, the structure to suppress the generation of the aggregated toner particles that can cause the defective images is the structure in which the protrusion 73*a* protruding from the inner wall surface is provided to reduce the size of the sandwich field, thereby reducing the size of the aggregated toner particles generated. Accordingly, with this structure, the function to suppress the generation of the aggregated toner particles that can cause the defective images is less influenced by use environment than the structure that regulates characteristic values of toner as disclosed in Japanese Patent No. 4462492.

Therefore, the pipeline unit 63 in which a part of the inner wall is pressed by the conveying coil 64 having elasticity arranged in the toner conveying path, is hardly influenced by use environment, and thus the generation of the aggregated toner particles that can cause the defective images can be suppressed.

Figure 4E:
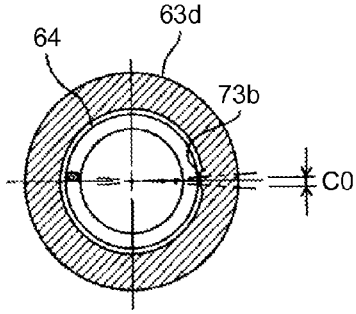

Furthermore, as illustrated in FIG. 4E, on a cross section of the pipe line unit 63 perpendicular to the toner conveying direction, a protrusion 73*b* having the circular arc outline protruding toward the hollow in the pipeline unit 63 is provided. By making the outline of the protrusion a circular arc, the length of the sandwich field indicated with C0 in FIG. 4E formed between the conveying coil 64 and the protrusion 73*b* can be shortened so as to approximate a state in which contact is made at one point (A1>A0>B>>C0). In other words, the area of the sandwich field in which the toner is sandwiched between the conveying coil 64 and the protrusion 73*b* serving as the inner wall surface of the second curved portion 63*d* can be further reduced. By reducing the area of the sandwich field as described above, the size of the aggregated toner particles generated when the toner is sandwiched in the sandwich field and while undergoing pressure can be substantially reduced, compared to the structure without a protrusion as illustrated in FIGS. 4B and 4C, and thus the generation of the aggregated toner particles that can cause the defective images can be further suppressed.

In the descriptions with reference to FIGS. 4B to 4E, the conveying coil 64 has no inclination to bend and is pressed so as to contact a certain position of the inner wall of the second curved portion 63*d*. If the accuracy of forming the protrusion 73*b* onto the second curved portion 63*d* is low or the conveying coil 64 has a severe inclination to bend, the conveying coil 64 may be pressed so as to contact also a part different from the protrusion 73*b* having the circular arc outline as illustrated in FIG. 4F.

Figure 4F:
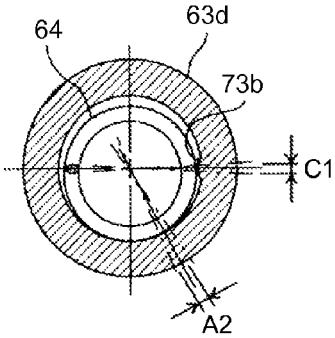

However, even if the conveying coil 64 is pressed so as to contact the field indicated with A2 in FIG. 4F, the direction to which the conveying coil 64 of the present example is pressed is substantially horizontal, thus the component of the contact pressure (the pressure) applied to the field indicated with A2 in FIG. 4F is small. Accordingly, the length of the sandwich fields (A2+C1) indicated with A2 and C1 in FIG. 4F is considerably shorter than the lengths of the sandwich fields indicated with A0 in FIG. 4B or A1 in FIG. 4C (A1>A0>>A2+C1>C0). As a result, although still larger than the state illustrated in FIG. 4E, the area of the sandwich field in which the toner is sandwiched between the conveying coil 64 and the inner wall part of the second curved portion 63*d* can be further reduced than the structure without the protrusion 73*b* as illustrated in FIGS. 4B and 4C. By reducing the area of the sandwich field as described above, the size of the aggregated toner particles generated when the toner is sandwiched in the sandwich field and while undergoing pressure can be reduced, and thus generation of the aggregated toner particles that can cause the defective images can be suppressed.

Figure 4G:
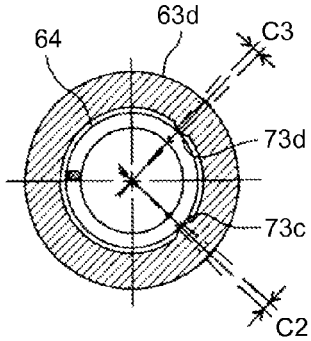

Even if the accuracy of forming the protrusion 73*b* onto the second curved portion 63*d* is low or the conveying coil 64 has a severe inclination to bend, the following structure can be used to enjoy advantageous effect of reducing the size of the aggregated toner particles than the structure illustrated in FIG. 4F. As illustrated in FIG. 4G, two (a plurality of) protrusions 73*c* and 73*d* are provided along the inner wall surface at the side of the smaller radius curvature of the second curved portion 63*d*. By providing two (a plurality of) protrusions in this manner, a field where the toner is sandwiched is limited to the two sandwich fields: the sandwich field formed between the conveying coil 64 and the protrusion 73*c*, and the sandwich field formed between the conveying coil 64 and the protrusion 73*d* even if the accuracy of forming the protrusion 73*b* is low or the conveying coil 64 has a severe inclination to bend.

Therefore, although still longer than the state illustrated in FIG. 4E, the length of the sandwich field in which the toner is sandwiched between the conveying coil 64 and the inner wall of the second curved portion 63*d* can be substantially shortened than the structure without the protrusions 73*b* nor 73*d* as illustrated in FIGS. 4B and 4C (A1>A0>>A2+C1>C2+C3>C0). By shortening the length of the sandwich field to reduce the area of the sandwich field, the generation of the aggregated toner particles that can cause the defective images can be suppressed even if the accuracy of forming the protrusions 73*b* and 73*d* onto the second curved portion 63*d* is low or the conveying coil 64 has a severe inclination to bend.

An example is described above in which the protrusion is provided in the second curved portion 63*d*. However, a similar advantageous effect to this example can be achieved also in the first curved portion 63*b*, by providing the protrusion along the inner wall surface at the side of the smaller radius of curvature r1 closer to the center of curvature CC1 of the first curved portion 63*b*.

In the present example, the protrusions are provided so that the two circular arc protrusions 72*c* and 72*d* are provided along the inner wall surface at the side of the smaller radius curvature of the first curved portion 63*b*, and the two circular arc protrusions 73*c* and 73*d* are provided along the inner wall surface at the side of the smaller radius curvature of the second curved portion 63*d*, to both of which the conveying coil 64 is pressed in a contacting manner, as illustrated in FIG. 3. As described above, by providing the protrusions along the inner wall surface at the side of the smaller radius curvature of the curved portions, where the aggregated toner particles are likely to be generated, the generation of the aggregated toner particles can be suppressed effectively. Additionally, it is possible to cut down the cost to form protrusions along, for example, the inner wall surface at the side of the larger radius curvature R1 or R2 of the curved portions further from the center of curvature CC1 or CC2, where no sandwich field is generated.

As described above, the structure in which one protrusion 73*b* is provided in the pipeline unit 63 is the most effective to reduce the area of the sandwich field as illustrated in FIG. 4E. Thus, the structure in which one protrusion 73*b* is provided in the pipeline unit 63 is the most preferred if a certain processing accuracy of forming the protrusion is ensured and problems such as the inclination to bend of the conveying coil 64 can be solved. If the shape of the curved portions or the contact pressure generated between the conveying coil 64 and the inner wall part of the curved portions is small, the structure in which one protrusion 73*b* is provided and the sandwich field is generated on a part different from the protrusion 73*b* as illustrated in FIG. 4F may be used.

An example in which the present invention is applied to the structure including two curved portions and three linear portions along the pipeline unit 63 serving as the toner conveying path forming member has been described. However, the present invention is not limited to this example. The present invention can also be applied, for example, to the structure including one curved portion and two linear portions, that is, the structure in which the second linear portion 63*c* and the second curved portion 63*d* are omitted and the third linear portion 63*e* is coupled to the downstream side of the first curved portion 63*b* in the toner conveying direction in FIGS. 2 and 3.

In such a structure, the conveying coil 64 is also partially pressed so as to contact the inner wall surface at the side of the smaller radius curvature of the first curved portion 63*b*. Therefore, the sandwich field in which the toner is sandwiched between the conveying coil 64 and the inner wall surface at the side of the smaller radius curvature of the first curved portion 63*b* is generated. By providing the protrusion along the inner wall surface at the side of the smaller radius curvature, likewise in the present example, the area of the sandwich field can be reduced to reduce the size of the aggregated toner particles generated, and thus the generation of the defective images caused by the aggregated toner particles can be suppressed.

Example 2

Figure 5:
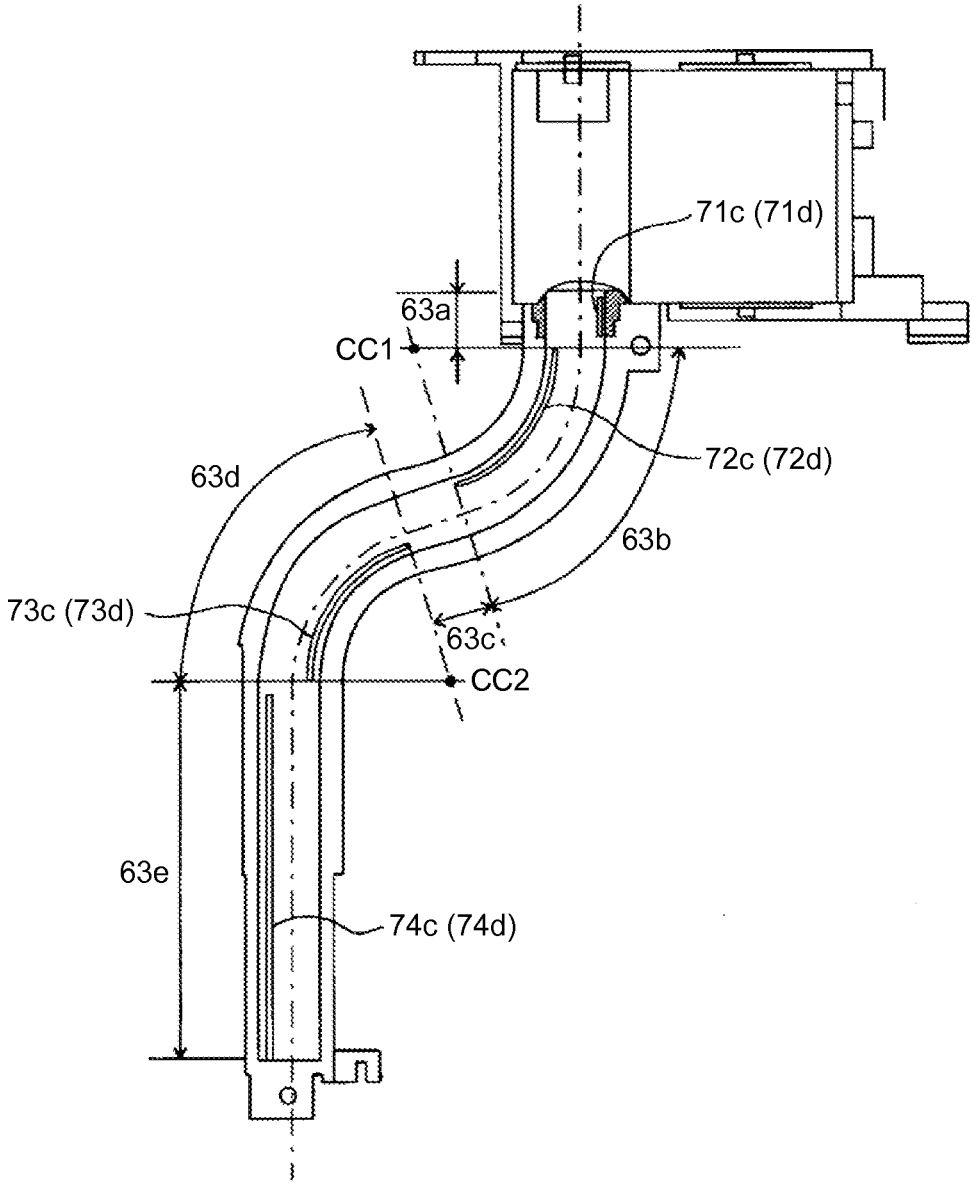
FIG. 5 is an arrangement diagram for explaining protrusions included in the pipeline unit according to Example 2 of the present embodiment.

As a second example of the present embodiment, Example 2 will now be described with reference to the accompanying drawings. The difference between Example 1 and Example 2 is that protrusions are provided along the inner wall surface not only in the curved portions but also in the linear portion of the pipeline unit. Therefore, the structure and operations, actions and effects same as Example 1 are omitted in the descriptions below. The same components as Example 1 are designated by the same reference numerals for description. FIG. 5 is an arrangement diagram for explaining protrusions included in the pipeline unit 63 according to Example 2.

As described above in Example 1, the conveying coil 64 serving as the toner conveying member provided in the toner conveying path of the hollow formed with the pipeline unit 63 is pressed so as to contact not only the inner wall surface at the side of the smaller radius curvature of the curved portions 63*b* and 63*d* but also the following parts as illustrated in FIG. 2. One of the parts is the inner wall surface on the first linear portion 63*a* on the upstream side of the first curved portion 63*b* in the toner conveying direction on the right side in FIG. 2 extending from the inner wall surface at the side of the larger radius curvature R1 of the first curved portion 63*b* further from the center of curvature CC1. Another part is the inner wall surface on the third linear portion 63*e* on the downstream side of the second curved portion 63*d* in the toner conveying direction on the left side in FIG. 2 extending from the inner wall surface at the side of the larger radius curvature R2 of the second curved portion 63*d* further from the center of curvature CC2. The sandwich field may be generated on these inner wall surfaces.

In this respect, in the present example, the following protrusions are provided as illustrated in FIG. 5 in addition to the protrusions 72*c* and 72*d* provided in the inner wall surface at the side of the smaller radius curvature of the first curved portion 63*b* and the protrusions 73*c* and 73*d* provided on the inner wall surface at the side of the smaller radius curvature of the second curved portion 63*d* in Example 1. Along the inner wall surface on the first linear portion 63*a* on the right side in FIG. 5 extending from the inner wall surface at the side of the larger radius curvature of the first curved portion, protrusions 71*c* and 71*d* are provided. Along the inner wall surface on the third linear portion 63*e* on the left side in FIG. 5 extending from the inner wall surface at the side of the larger radius curvature of the second curved portion, protrusions 74*c* and 74*d* are provided.

With the structure of the pipeline unit 63 described above, all areas of the sandwich fields generated in the pipeline unit 63 can be reduced. Therefore, the size of the aggregated toner particles generated can be further reduced than the structure according to Example 1, whereby the defective images such as white dots or uneven brightness on images caused by smaller aggregated toner particles than the structure according to Example 1, can also be suppressed. In other words, the defective images caused by aggregated toner particles can be further suppressed than the structure according to Example 1.

With this structure, likewise in Example 1, the function to suppress the generation of the aggregated toner particles that can cause the defective images is less influenced by use environment than the structure that regulates characteristic values of toner as disclosed in Japanese Patent No. 4462492.

Therefore, the pipeline unit 63 in which a part of the inner wall is pressed by the conveying coil 64 having elasticity arranged in the toner conveying path, is hardly influenced by use environment, and thus the generation of the aggregated toner particles that can cause the defective images can be further suppressed than the structure according to Example 1.

An example in which the present invention is applied to the structure including the circular arc protrusions 73*c* and 73*d* illustrated in FIG. 4G referred to in the description on Example 1 has been described. However, the present invention is not limited to this example. The present invention can also be applied, for example, to the structures illustrated in FIGS. 4D to 4F likewise in Example 1.

An example in which the present invention is applied to the structure including two curved portions and three linear portions along the pipeline unit 63 has been described. However, the present invention is not limited to this example. The present invention can also be applied, for example, to the structure including one curved portion and two linear portions, that is, the structure in which the second linear portion 63*c* and the second curved portion 63*d* are omitted and the third linear portion 63*e* is coupled to the downstream side of the first curved portion 63*b* in the toner conveying direction in FIGS. 2 and 3.

Example 3

Figure 6A:
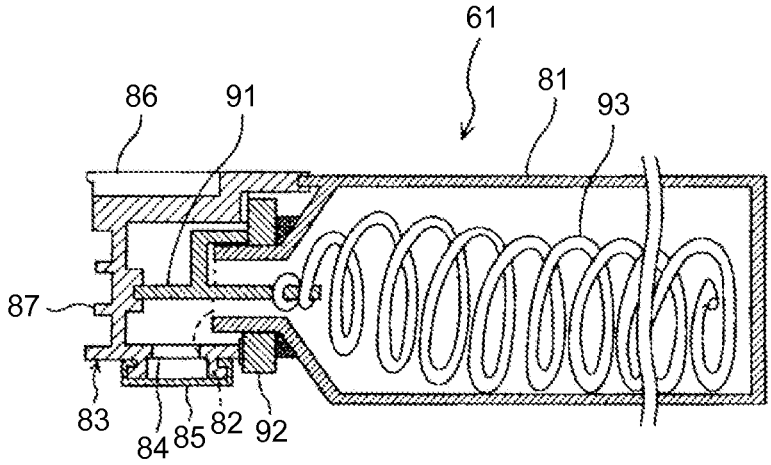
FIGS. 6A to 6C are explanatory diagrams of a toner bottle serving as a toner housing container provided on a conventional toner replenishment unit in the related art.
Figure 6B:
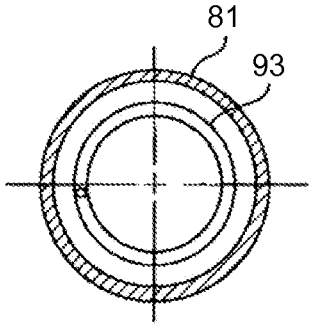
Figure 6C:
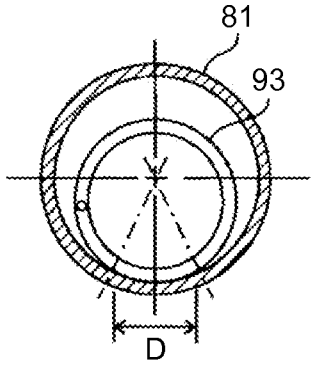
Figure 7A:
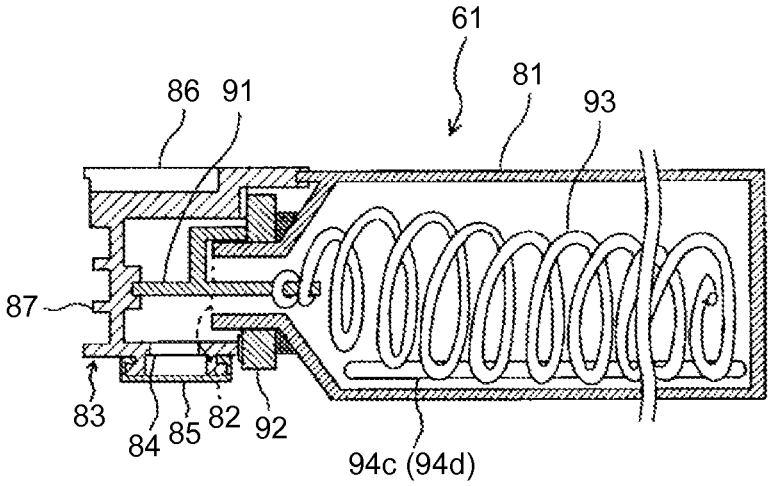
FIGS. 7A to 7C are explanatory diagrams of a toner bottle serving as a toner housing container provided on a toner replenishment unit according to Example 3 of the present embodiment.
Figure 7B:
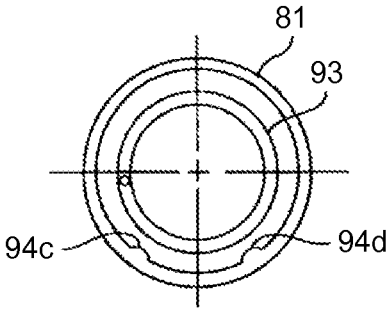
Figure 7C:
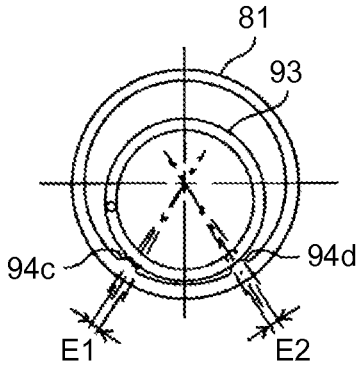

As a third example of the present embodiment, Example 3 will now be described with reference to the accompanying drawings. The only differing point of Example 3 from Example 1 and Example 2 is that the toner conveying path forming member to which the present invention is applied is not the pipeline unit 63 but the bottle main body 81 of the toner bottle 61 serving as the toner housing container in the present embodiment. Therefore, the structure and operations, actions and effects that are the same as in Examples 1 and 2 are omitted in the descriptions below. The same components are designated by the same reference numerals for description. FIGS. 6A to 6C are explanatory diagrams of the toner bottle 61 serving as a toner housing container provided on a conventional toner replenishment unit 60. FIGS. 7A to 7C are explanatory diagrams of the toner bottle 61 serving as the toner housing container provided on the toner replenishment unit 60 according to Example 3 of the present embodiment.

In the related art, an image forming apparatus has been known including a conveying coil 93 having elasticity as a conveying member that conveys the toner housed in a toner bottle toward an outlet of the toner bottle 82 in the bottle main body 81 of the toner bottle 61 detachable from the main body 100 as illustrated in FIG. 6A. In other words, the bottle main body 81 of the toner bottle 61 functions also as the toner conveying path forming member that conveys the toner. The toner bottle 61 illustrated in FIG. 6A mainly includes the bottle main body 81 serving as the toner conveying path forming member, inside the hollow of which the conveying coil 93 is arranged, a conveying coil 93 that conveys the toner, a driving member 91 that drives the conveying coil 93 to rotate, and a toner cap part 83 serving as a case.

The bottle main body 81 according to the present example has the hollow section as illustrated in FIG. 6B, inside of which the conveying coil 93 is arranged. The bottle main body 81 is attached in the main body 100 in a detachable manner with the driving member 91 and the toner cap part 83 attached thereto. The conveying coil 93 is arranged inside the hollow of the bottle main body 81. The conveying coil 93 is in a spiral shape and its one end is coupled to a shaft of the driving member 91, and driven to rotate by the rotation of the driving member 91, thereby conveying the toner contained in the bottle main body 81 toward the outlet of the toner bottle 82. The driving member 91 has a gear part 92 with which a driving motor (not illustrated) provided on the main body 100 side engages in the state in which the toner bottle 61 is attached in the main body 100. The driving member 91 is thus driven to rotate, thereby rotating the conveying coil 93 coupled to the shaft of the driving member 91.

The toner cap part 83 is arranged so as to be fitted into a protrusion of the bottle main body 81 while supporting the driving member 91 rotatably and fitting a protrusion 87 into the main body 100 side. Below the toner cap part 83, an outlet of the toner 84 and a shutter 85 are provided. When the toner bottle 61 is attached to the main body 100 and a knob 86 is pinched to rotate the toner cap part 83, the shutter 85 opens.

In the toner bottle 61 structured as described above in the related art, the conveying coil 93 having elasticity is hanging down due to the effect of gravity and pressed in a contacting manner onto the inner wall surface on the lower part of the bottle main body 81 as illustrated in FIG. 6A. Specifically, the conveying coil 93 is coupled at one end thereof to the shaft of the driving member 91 in the vicinity of the outlet of the toner bottle 82 as illustrated in FIG. 6A. Accordingly, in the vicinity of the outlet of the toner bottle 82, the center line of the conveying path of the bottle main body 81 and the center line of the conveying coil 93 are almost coaxial when projected on a cross section perpendicular to the center line of the conveying path of the bottle main body 81 as illustrated in FIGS. 6A and 6B. However, in a part away from the outlet of the toner bottle 82, the conveying coil 93 is hanging down due to the effect of gravity as illustrated in FIGS. 6A and 6C, thereby generating the sandwich field with the length of the sandwich field indicated with D in FIG. 6C. In the sandwich field, in the same manner as the pipeline unit 63 described in Examples 1 and 2, the toner is sandwiched and undergoes pressure to generate the aggregated toner particles.

In this respect, in the present example, two protrusions 94*c* and 94*d* having the circular arc outline protruding toward the hollow in the bottle main body 81 are provided along the inner wall surface on the lower part of the bottle main body 81 as illustrated in FIGS. 7B and 7C.

With the structure of the bottle main body 81 described above, the length of the sandwich field formed between the bottle main body 81 and the conveying coil 93 is made to be the lengths of the sandwich fields indicated with E1 and E2 in FIG. 7C. The lengths are considerably shorter than the length of the sandwich field indicated with D in FIG. 6C, whereby the area of the sandwich field can also be reduced. Therefore, the size of the aggregated toner particles generated can be further reduced than the structure in the related art illustrated in FIGS. 6A to 6C, whereby the defective images such as a white vertical line on images caused by aggregated toner particles can be further suppressed than the structure according to the related art.

Likewise in Examples 1 and 2, the function to suppress the generation of the aggregated toner particles that can cause the defective images is less influenced by use environment than the structure that regulates characteristic values of toner as disclosed in Japanese Patent No. 4462492.

Therefore, the bottle main body 81 of the toner bottle 61*a* part of the inner wall of which is pressed by the conveying coil 93 having elasticity arranged in the toner conveying path, is hardly influenced by use environment, and thus the generation of the aggregated toner particles that can cause the defective images can be suppressed.

An example in which the present invention is applied to the structure including the circular arc protrusions 94*c* and 94*d* corresponding to the circular arc protrusions 73*c* and 73*d* illustrated in FIG. 4G referred to in the description on Example 1 has been described. However, the present invention is not limited to this example. The present invention can also be applied, for example, to the structures illustrated in FIGS. 4D to 4F likewise in Examples 1 and 2.

By providing the toner conveying path forming member according to each of Examples of the present embodiment, the toner replenishment unit 60 can be provided in which generation of the aggregated toner particles that can cause the defective images in the toner conveying path forming member is suppressed regardless of the use environment.

By including the toner replenishment unit 60, the printer 500 can be provided in which generation of the aggregated toner particles that can cause the defective images in the toner conveying path forming member is suppressed regardless of the use environment.

The present embodiment has described examples of the toner conveying path forming member a part of the inner wall of which is pressed by the toner conveying member arranged inside the hollow in the toner conveying path, the toner replenishment unit having the toner conveying path forming member, and an image forming apparatus having the toner replenishment unit. However, the present invention is not limited to these structures. The present invention can also be applied, for example, to the toner conveying device having the toner conveying path forming member and the toner conveying member provided in the toner conveying path, the toner replenishment unit having the toner conveying device, and the image forming apparatus that includes the toner conveying device or the toner replenishment unit.

The embodiments have been described by way of example only, the present invention has specific advantageous effects for each of the following aspects.

Aspect A

In a toner conveying path forming member that forms a toner conveying path with a hollow capable of conveying toner, the toner conveying path forming member such as the pipeline unit 63 includes an inner wall a part of which is pressed by an elastic toner conveying member such as the conveying coil 64 provided in the toner conveying path; and a protrusion, such as the protrusion 72*c* or the protrusion 73*c*, that is provided on the first curved portion 63*b* or the second curved portion 63*d* to protrude toward the hollow.

According to the aspect, as described in Examples 1 through 3, the toner conveying path forming member can be provided, that is, the toner conveying path forming member a part of the inner wall of which is pressed by the elastic toner conveying member such as the conveying coil 64 provided in the toner conveying path, which is hardly influenced by use environment, and thus the generation of the aggregated toner particles that can cause defective images can be suppressed.

Aspect B

The inner wall surface according to aspect A further includes a curved portion, such as the first curved portion 63*b*, at which a center line of the toner conveying path forming member, such as the pipeline unit 63, that passes through a center of a hollow section perpendicular to a toner conveying direction conveying path forming member is bent. The protrusion, such as the protrusion 72*c*, is provided on an inner wall surface of the curved portion at the side of a smaller radius curvature closer to a center of curvature of the curved portion.

According to the aspect, as described in Example 1, by providing the protrusion such as the protrusion 72*c* along the inner wall surface at the side of the smaller radius curvature of the curved portion such as the first curved portion 63*b*, where the aggregated toner particles are likely to be generated, the generation of the aggregated toner particles can be suppressed effectively. Additionally, the cost to form protrusion along, for example, the inner wall surface at the side of the larger radius curvature of the curved portion further from the center of curvature of the curved portion where no sandwich field is generated, can be reduced.

Aspect C

The inner wall surface according to aspect A further includes a curved portion, such as the first curved portion 63*b*, at which a center line of the toner conveying path forming member, such as the pipeline unit 63, that passes through a center of a hollow section perpendicular to a toner conveying direction is bent; a first linear portion, such as the first linear portion 63*a*, that is coupled to the curved portion on an upstream side in the toner conveying direction; and a second linear portion, such as the third linear portion 63*e*, that is coupled to the curved portion on a downstream side in the toner conveying direction. A first protrusion, such as the protrusions 72*c* and 72*d*, is provided on an inner wall surface at the side of a smaller radius curvature closer to a center of curvature of the curved portion. A second protrusion is provided on an inner wall surface of the first linear portion extending from an inner wall surface at the side of a larger radius of the curved portion further from the center of curvature. A third protrusion is provided on an inner wall surface of the second linear portion extending from the inner wall surface of the curved portion at the side of the larger radius curvature.

According to the aspect, as described in Example 2, the toner conveying path forming member, such as the pipeline unit 63, can be provided hardly influenced by use environment, the generation of the aggregated toner particles that can cause defective images can be more suppressed compared to the structure in which the protrusion such as the protrusion 72*c* is provided only on the curved portion such as the first curved portion 63*b*.

Aspect D

The inner wall surface according to aspect A further includes a first curved portion, such as the first curved portion 63*b*, at which a center line of the toner conveying path forming member that passes through a center of a hollow section perpendicular to a toner conveying direction is bent; and a second curved portion, such as the second linear portion 63*c*, at which the center line of the toner conveying path forming member is bent to the opposite side from the first curved portion. The second curved portion is arranged on a downstream side of the first curved portion in the toner conveying direction. A first protrusion, such as the protrusions 72*a* and 73*a*, is provided on an inner wall surface of the first curved portion at the side of a smaller radius curvature closer to a center of curvature of the first curved portion. A second protrusion is provided on an inner wall surface of the second curved portion at the side of the smaller radius curvature closer to a center of curvature of the second curved portion.

According to the aspect, as described in Example 1, by providing the protrusion, such as the protrusions 72*c* and 72*d* and the protrusions 73*c* and 73*d*, along the inner wall surfaces at the side of the smaller radius curvature of the first and second curved portions, such as the first curved portion 63*b* and the second curved portion 63*c*, where the aggregated toner particles are likely to be generated, the generation of the aggregated toner particles can be suppressed effectively. Additionally, the cost to form protrusions along, for example, the inner wall surface at the side of the larger radius curvature of the curved portions further from the center of curvature, where no sandwich field is generated, can be reduced.

Aspect E

The inner wall surface according to aspect A further includes a first curved portion, such as the first curved portion 63*b*, at which a center line of the toner conveying path forming member that passes through a center of a hollow section perpendicular to a toner conveying direction is bent; a first linear portion, such as the first linear portion 63*a*, that is coupled to the first curved portion on an upstream side in the toner conveying direction; a second curved portion, such as the second curved portion 63*b*, at which the center line of which is bent to the opposite side from the first curved portion, the second curved portion being arranged on the downstream side of the first curved portion in the toner conveying direction; and a second linear portion, such as the third linear portion 63*e*, that is coupled to the second curved portion on a downstream side in the toner conveying direction. A first protrusion, such as the protrusions 72*c* and 72*d*, is provided on an inner wall surface of the first curved portion at the side of a smaller radius curvature closer to a center of curvature of the first curved portion. A second protrusion is provided on an inner wall surface of the second curved portion at the side of a smaller radius curvature closer to a center of curvature of the second curved portion. A third protrusion is provided on an inner wall surface of the first linear portion extending from an inner wall surface of the first curved portion at the side of a larger radius curvature further from a center of curvature of the first curved portion. A fourth protrusion is provided on an inner wall surface of the second linear portion at the side of a larger radius curvature further from a center of curvature of the second curved portion.

According to the aspect, as described in Example 2, the toner conveying path forming member, such as the pipeline unit 63, can be provided, which is hardly influenced by use environment, whereby the generation of the aggregated toner particles that can cause defective images can be more suppressed compared to the structure in which the protrusion, such as the protrusions 72*c* and 73*c*, are provided only on the curved portion, such as the first curved portion 63*b* and the second curved portion 63*d*.

Aspect F

In the toner conveying path forming member according to Aspect A, the toner conveying path forming member is a toner housing container such as the bottle main body 81 of the toner bottle 61.

According to the aspect, as described in Example 3, the toner housing container such as the bottle main body 81 of the toner bottle 61 can be provided, which is hardly influenced by use environment, and thus the generation of the aggregated toner particles that can cause defective images can be suppressed.

Aspect G

In any one of Aspects A to F, the protrusion has a circular arc outline in a cross section perpendicular to a toner conveying direction of the toner conveying path forming member, such as the pipeline unit 63 and the bottle main body 81 of the toner bottle 61.

According to the aspect, as described in Examples 1 through 3, the length of the sandwich field formed between the toner conveying member such as the conveying coil 64 and the conveying coil 93, and the protrusion can be shortened so as to approximate a state in which contact is made at one point. Therefore, the size of the aggregated toner particles generated when the toner is sandwiched in the sandwich field and undergoes pressure can be substantially reduced, compared to the structure without a protrusion, and thus the generation of the aggregated toner particles that can cause defective images can be further suppressed.

Aspect H

In Aspects A or B, a plurality of protrusions, such as the protrusions 72*c* and 72*d* or the protrusions 71*c* and 71*d*, are provided on the inner wall surfaces, such as the inner wall surface at the side of the smaller radius curvature of the first curved portion 63*b* and the inner wall surface on the lower part of the bottle main body 81.

According to the aspect, as described in Examples 1 through 3, even if the accuracy of forming the protrusions, such as protrusions 72*c* and 72*d* or the protrusions 71*c* and 71*d*, onto the first curved portion 63*b* or the bottle main body 81 of the toner bottle 61 is low or the conveying member such as the conveying coil 64 or the conveying coil 93 has a severe inclination to bend, the generation of the aggregated toner particles that can cause defective images can be suppressed.

Aspect I

A toner replenishment unit such as the toner replenishment unit 60 includes a toner conveying path forming member such as the pipeline unit 63 and the bottle main body 81 of the toner bottle 61 that conveys toner to be supplied to a developing unit such as the developing unit 6. The toner conveying path forming member is the toner conveying path forming member according to any one of Aspects A to H, such as the pipeline unit 63 and the bottle main body 81 of the toner bottle 61.

According to the aspect, as described in Examples 1 through 3, the toner replenishment unit such as the toner replenishment unit 60 that is hardly influenced by use environment and capable of suppressing the generation of the aggregated toner particles that can cause defective images in the toner conveying path forming member such as the pipeline unit 63 and the bottle main body 81 of the toner bottle 61 can be provided.

Aspect J

An image forming apparatus such as the printer 500 includes a toner replenishment unit that conveys toner to be supplied to a developing unit such as the developing unit 6. The toner replenishment unit is the toner replenishment unit according to Aspect I, such as the toner replenishment unit 60.

According to the aspect, as described in the embodiment, the printer 500 that is hardly influenced by use environment and capable of suppressing the generation of the aggregated toner particles that can cause defective images in the toner conveying path forming member such as the pipeline unit 63 and the bottle main body 81 of the toner bottle 61 can be provided.

According to the present invention, by providing a protrusion protruding toward a hollow on the inner wall surface pressed by the toner conveying member, the area of the inner wall surface of the toner conveying path forming member that forms the sandwich field with the toner conveying member can be reduced compared to the structure without the protrusion protruding toward the inner wall surface. As a result, the area of the sandwich field when projected onto a cross section in parallel with or perpendicular to the toner conveying direction can also be reduced compared to the structure without the protrusion protruding toward the inner wall surface. In other words, the size of the sandwich field in which the toner is sandwiched between the inner wall surface of the toner conveying path forming member and the toner conveying member can be reduced, compared to the structure without the protrusion.

Therefore, even if the aggregated toner particles are generated in the sandwich field, the size of the aggregated toner particles can be reduced compared to the structure without the protrusion, whereby generation of the aggregated toner particles that can cause the defective images can be suppressed.

As described above, the structure to suppress the generation of the aggregated toner particles that can cause the defective images is the structure in which the protrusion protruding toward the inner wall surface of the toner conveying path forming member is provided to reduce the size of the sandwich field that sandwiches the toner, thereby reducing the size of the aggregated toner particles generated. Accordingly, with this structure, the function to suppress the generation of the aggregated toner particles that can cause the defective images is less influenced by use environment than the structure that regulates characteristic values of toner as disclosed in Japanese Patent No. 4462492.

The present invention provides the following toner conveying path forming member. The toner conveying path forming member has an inner wall a part of which is pressed by an elastic toner conveying member arranged in a toner conveying path. The toner conveying path forming member is hardly influenced by use environment, and suppresses the generation of the aggregated toner particles that can cause defective images.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A toner conveying path forming member including a hollow configured to convey toner, the toner conveying path forming member comprising:

a protrusion on part of an inner wall of the toner conveying path forming member configured to be pressed by an elastic toner conveying member, the protrusion configured to protrude toward the hollow, wherein the toner conveying path forming member includes a curved portion, and the part of the inner wall having the protrusion thereon is a small radius curvature of the curved portion.

2. The toner conveying path forming member according to claim 1, further comprising:

a first linear portion coupled to the curved portion on an upstream side in the toner conveying direction; and a second linear portion coupled to the curved portion on a downstream side in the toner conveying direction, wherein a first protrusion on an inner wall surface of the curved portion at the side of a smaller radius curvature closer to a center of curvature of the curved portion, a second protrusion on an inner wall surface of the first linear portion extending from an inner wall surface of the curved portion at the side of a larger radius curvature further from the center of curvature, and a third protrusion on an inner wall surface of the second linear portion extending from the inner wall surface of the curved portion at the side of the larger radius curvature.

3. The toner conveying path forming member according to claim 1, further comprising:

a first curved portion at which a center line of the toner conveying path forming member that passes through a center of a hollow section perpendicular to a toner conveying direction is bent; and a second curved portion at which the center line of the toner conveying path forming member is bent to the opposite side from the first curved portion, the second curved portion being arranged on a downstream side of the first curved portion in the toner conveying direction, wherein a first protrusion on an inner wall surface of the first curved portion at the side of a smaller radius curvature closer to a center of curvature of the first curved portion, and a second protrusion on an inner wall surface of the second curved portion at the side of the smaller radius curvature closer to a center of curvature of the second curved portion.

4. The toner conveying path forming member according to claim 1, further comprising:

a first curved portion at which a center line of the toner conveying path forming member that passes through a center of a hollow section perpendicular to a toner conveying direction is bent;

a first linear portion coupled to the first curved portion on an upstream side in the toner conveying direction;

a second curved portion at which the center line of the toner conveying path forming member is bent to the opposite side from the first curved portion, the second curved portion being arranged on a downstream side of the first curved portion in the toner conveying direction; and a second linear portion coupled to the second curved portion on a downstream side in the toner conveying direction, wherein a first protrusion on an inner wall surface of the first curved portion at the side of a smaller radius curvature closer to a center of curvature of the first curved portion, a second protrusion on an inner wall surface of the second curved portion at the side of a smaller radius curvature closer to a center of curvature of the second curved portion, a third protrusion on an inner wall surface of the first linear portion extending from an inner wall surface of the first curved portion at the side of a larger radius curvature further from a center of curvature of the first curved portion, and a fourth protrusion on an inner wall surface of the second linear portion extending from an inner wall surface of the second curved portion at the side of a larger radius curvature further from a center of curvature of the second curved portion.

5. The toner conveying path forming member according to claim 1, wherein the toner conveying path forming member is a toner housing container.

6. The toner conveying path forming member according to claim 1, wherein the protrusion has a circular arc outline in a cross section perpendicular to a toner conveying direction of the toner conveying path forming member.

7. A toner conveying path forming member including a hollow configured to convey toner, the toner conveying path forming member comprising:

a plurality of protrusions on a curved part of an inner wall of the toner conveying path forming member that is configured to be pressed by an elastic toner conveying member, the protrusions configured to protrude toward the hollow.

8. A toner replenishment unit comprising:

the toner conveying path forming member according to claim 1, wherein the toner conveying path forming member is configured to convey toner to be supplied to a developing unit.

9. An image forming apparatus comprising:

the toner replenishment unit according to claim 8; and a hopper configured to temporarily hold the toner.

10. A pipeline having an elastic conveying coil running therethrough, the elastic conveying coil configured to convey toner, the pipeline comprising:

a protrusion on an inner wall of a non-linear portion of the pipeline in a region that a gravitational force drives the conveying coil in a first direction toward the inner wall, the protrusion configured to contact the conveying coil and force the conveying coil in a second direction different from the first direction.

11. The pipeline of claim 10, wherein the protrusion is configured to reduce a portion of a surface area of the elastic conveying coil that contacts the pipeline.

* * * * *